US006999704B2

(12) United States Patent
Hayashi et al.

(10) Patent No.: US 6,999,704 B2
(45) Date of Patent: Feb. 14, 2006

(54) DEVELOPING APPARATUS IN AN IMAGE FORMING APPARATUS

(75) Inventors: Koichi Hayashi, Osaka (JP); Hiroyoshi Tode, Osaka (JP); Yojiro Sato, Osaka (JP); Koujyu Yamamoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 57 days.

(21) Appl. No.: 10/697,558

(22) Filed: Oct. 31, 2003

(65) Prior Publication Data

US 2004/0141774 A1 Jul. 22, 2004

(30) Foreign Application Priority Data

Oct. 31, 2002 (JP) ..... 2002-318458
Oct. 31, 2002 (JP) ..... 2002-318504

(51) Int. Cl.
*G03G 15/08* (2006.01)

(52) U.S. Cl. ..... 399/258; 222/DIG. 1; 399/119; 399/260

(58) Field of Classification Search ..... 399/258, 399/262, 260, 120, 119; 222/DIG. 1
See application file for complete search history.

(56) References Cited

U.S. PATENT DOCUMENTS 4,373,468 A * 2/1983 Suda et al. ..... 399/258 X
5,034,776 A * 7/1991 Sugiura ..... 222/DIG. 1 X
5,142,335 A * 8/1992 Sakata et al. ..... 222/DIG. 1 X
5,345,298 A * 9/1994 Corrigan, Jr. ..... 399/260
5,587,777 A * 12/1996 Miyaji et al.
5,604,572 A * 2/1997 Suzuki et al. ..... 399/119
5,724,635 A * 3/1998 Nagaoka et al. ..... 399/260
6,229,976 B1 * 5/2001 Kimura ..... 399/262
6,324,369 B1 * 11/2001 Yamaguchi et al. .... 399/119 X
2002/0025195 A1 * 2/2002 Iwata et al. ..... 399/258
2002/0025196 A1 * 2/2002 Matsumoto et al. ..... 399/258
2002/0090230 A1 * 7/2002 Hatori et al. ..... 399/258 X
2003/0026628 A1 * 2/2003 Arimoto ..... 399/258 X

FOREIGN PATENT DOCUMENTS

JP 3078501 B2 6/2000
JP 2001235933 A 8/2001
JP 200272645 A 3/2002

* cited by examiner

*Primary Examiner*—Sophia S. Chen
(74) *Attorney, Agent, or Firm*—Crowell & Moring LLP

(57) ABSTRACT

In a development apparatus of the present invention, a guide member is provided which extends through the toner receiving opening located above the agitation/transfer device to surround the pathway of the toner falling from the toner container to guide the same to the agitation/transfer device, the guide member is formed to be broaden toward the agitation/transfer device, and the bottom edge part of the guide member facing the agitation/transfer device is shaped to run along the rotational circumference of the agitation/transfer device, so that the piling up of toner between the agitation/transfer device and inner wall of the developing apparatus is prevented.

12 Claims, 5 Drawing Sheets

DEVELOPING APPARATUS IN AN IMAGE FORMING APPARATUS

BACKGROUND OF THE INVENTION

1. Field of the Invention

The present invention relates to a developing apparatus in an image forming apparatus using electrophotographic method such as a copying machine, printer, facsimile machine, or combined machine of them, specifically to a developing apparatus in an image forming apparatus, having a transfer means for transferring developer to a developing roller for developing the latent image on a photo conductor while agitating the developer and a toner accommodating means such as a toner container from which the toner is supplied to a toner agitation/transfer means.

2. Description of the Related Art

Among electrophotographic image forming apparat uses, there is one in which a developing roller carrying the developer containing toner for developing a latent image formed on a photo conductor and an agitation/transfer means of developer for supplying charged toner to said developing roller are used. There has been proposed a developing apparatus, for example, in which a sensor for detecting toner concentration and a toner container detachably mountable to said main assembly of a developing apparatus detachable from the developing apparatus are provided, the toner in the container being able to be supplied by a signal from a control circuit, and the toner is supplied from the toner container when the toner concentration in the developer decreases with decreased amount of the toner as the toner is consumed for developing the latent image on the photo conductor.

There is also proposed a developing apparatus with which toner is supplied not only when toner concentration has decreased, as disclosed in Japanese Patent Laid-Open Publication No. 2002-72645, in which a mechanism for reciprocating a toner cartridge to supply toner is provided to move the toner toward a discharge opening formed in an end in the toner cartridge, and the toner is allowed to fall freely from the opening.

However, with the developing apparatus like this, a censor for detecting the concentration of toner, a driving source for supplying toner when the toner concentration decreases, a device including a control circuit, and a mechanism for reciprocating the toner cartridge, are necessary to be provided, and the apparatus becomes inevitably complicated and expensive. Further, in the case of the apparatus counted with the mechanism for reciprocating the toner cartridge, vibration is transmitted to the image forming apparatus itself and there is a possibility of occurring image deterioration due to the influence of the vibration to other mechanisms of the machine.

To solve the problem mentioned above the applicant of the present invention proposed in Japanese Patent Laid-Open Publication No. 2001-235933, which relates to a developing apparatus of so-called one-component developing system in which only toner is carried on its developing roller a developing apparatus in which the driving force of toner transfer means in a toner container is obtained from a driving source for driving the developing roller, etc. of the developing apparatus and the toner is transferred by the transfer means and allowed to fall freely from a toner receiving opening formed in an end of the developing apparatus, thus the toner can be supplied without a particular driving source, control circuit, and reciprocating mechanism. Further, the applicant proposed a means to prevent the clogging of toner by reducing partially the transferring ability of an agitation/transfer means in the downstream zone from the position where toner falls on the agitation/transfer means, because when toner is transferred uniformly by the agitation/transfer means, the toner supplied from the toner receiving opening is transferred immediately and toner is further supplied from the toner receiving opening, resulting in excessive supply of the toner and the clogging of toner is induced.

However, with the developing apparatus proposed in said Japanese Patent Laid-Open Publication No. 2001-235933, when, for example, the maximum size of recording medium handled in the image forming apparatus is A4 or so, the toner can be supplied without the occurrence of toner clogging by determining the clearance between the periphery of the agitation/transfer means and inner wall of the developing apparatus to be 1mm or so. But, in the case of an image forming apparatus in which large recording medium such as A3 size is handled, there arises the necessity for increasing said clearance to 2 mm or so, because it is concerned that deflection increases in the agitation/transfer means; whereas if the clearance between the periphery of the agitation/transfer means and inner wall of the developing apparatus is increased like this, then the supplied toner is formed into a lump like soft cake in the clearance, that is, so-called soft caking occurs. Accordingly, the toner supplied from the toner container can not fall and toner supply to the agitation/transfer means is obstructed, resulting in problems such as the occurrence of irregular image formation, etc. due to toner shortage.

Further, when removing the toner container emptied out from the developing apparatus, the toner remained in the toner container may fall onto the agitation/transfer means of the developing apparatus. Then, the toner piles on the agitation/transfer means in the developing apparatus proper and forms into a lump like soft cake, which hinders free falling of the toner, and the supply of toner to the developing apparatus proper is obstructed and the amount of toner in the developing apparatus proper decreases, resulting in insufficient supply of toner to the developing roller. As a result, problems such as irregular image formation may occur.

As to the leveling off of the piled toner a developing apparatus is disclosed in Japanese Patent No. 3078501. In the developing apparatus, when filling toner from a cartridge to a toner hopper provided on the upper part of the developing apparatus, the toner fallen onto the toner hopper is leveled off by the mounting/demounting of the cartridge and the opening/closing action of a shutter. However, with the developing apparatus, the toner is leveled off when the toner hopper provided on the upper part thereof is emptied and all of the toner in the cartridge is transferred to the toner hopper; whereas with the developing apparatus disclosed in said Japanese Patent Laid-Open Publication No. 2001-235933, only the amount of toner corresponding to consumed amount of toner is allowed to fall freely onto the agitation/transfer means without using a particular driving source and control circuit, and by this the toner piled on the agitation/transfer means is not leveled off. With the developing apparatus of said Japanese Patent No. 3078501, a complicated mechanism is required for moving a leveling plate or leveling member together with the mounting/dismounting of the cartridge and the opening/closing action of the shutter, and the cost of the apparatus increases inevitably.

Therefore, in the developing apparatus of an image forming apparatus, in which the toner is allowed to fall onto the agitation/transfer means without the necessity of providing on the toner container side a driving source for supplying the toner and control circuit for controlling the driving source, there is a problem to be solved so that the occurrence of irregular image formation is prevented, which is caused by insufficient supply of toner to the developing roller due to the shortage of toner in the developing apparatus owing to the phenomenon that the toner is clogged in the clearance between the periphery of the agitation/transfer means and inner wall of the developing apparatus to be formed into a lump like soft cake and the free-falling thereof is hindered when a container containing new toner is mounted in the case the clearance is increased.

There is also a problem to be solved so that the occurrence of irregular image formation is prevented, which is caused by the phenomenon that when removing the toner container from the developing apparatus the toner remained in the toner container may fall onto the agitation/transfer means of the developing apparatus and piles thereon to be formed into a lump like soft cake, and then when a container containing new toner is mounted the toner is hindered from free falling and the supply of toner to the developing apparatus become impossible.

SUMMARY OF THE INVENTION

An object of the present invention is to provide a developing apparatus in an image forming apparatus, the developing apparatus being composed such that the clogging of toner between the periphery of the toner agitation/transfer means and inner wall of the developing apparatus is prevented with simple and inexpensive construction. Another object of the present invention is to provide a developing apparatus which is composed such that, when demounting/mounting the toner accommodating means such as a toner container to or from the developing apparatus, the toner piled and caked on the toner agitation/transfer means is collapsed by a simple and inexpensive construction in order to prevent the obstruction of toner supply from the toner supply opening of the toner container.

According to the present invention, a developing apparatus in an image forming apparatus is provided, the developing apparatus comprising an agitation/transfer means for supplying the developer while agitating the same to a developing roller for developing the latent image formed on a photo conductor and a toner accommodating means which has a toner supply opening and is mounted detachably above said agitation/transfer means, the toner in said toner accommodating means being to be supplied to said agitation/transfer means through a toner receiving opening located above the agitation/transfer means, characterized in that a guide member is provided at said toner receiving opening such that said guide member extends from the toner receiving opening toward the agitation/transfer means near to the same to surround the pathway of the toner falling from the toner accommodating means in order to prevent the piling up of toner between the agitation/transfer means and developing device proper.

According to the present invention, a developing apparatus in an image forming apparatus, the developing apparatus comprising an agitation/transfer means for supplying the developer while agitating the same to a developing roller for developing the latent image formed on a photo conductor, and a toner accommodating means which has a toner supply opening and is mounted detachably above said agitation/transfer means, the toner in said toner accommodating means being to be supplied to said agitation/transfer means through a toner receiving opening located above the agitation/transfer means, characterized in that a guide member is provided on said toner accommodating means such that, when the toner accommodating means is mounted above said agitation/transfer means, said guide member extends through the toner receiving opening toward the agitation/transfer means near to the same to surround the pathway of the toner falling from the toner accommodating means in order to prevent the piling up of toner between the agitation/transfer means and developing device proper.

In the present invention, said guide member is formed in the shape broaden toward the agitation/transfer means.

In the present invention, said guide member is formed such that the agitation/transfer side thereof is shaped to run along the rotation circumference of the agitation/transfer means.

In the present invention, a scraper for scraping out the toner piled at the guide member is provided to the agitation/transfer means at the location corresponding to the location of the guide member.

In the present invention. The developing apparatus of the invention is provided with a shutter mechanism which allows the toner receiving opening to be opened or closed by means of the guide member.

DETAILED DESCRIPTION OF THE PREFERRED EMBODIMENTS

Figure 1:
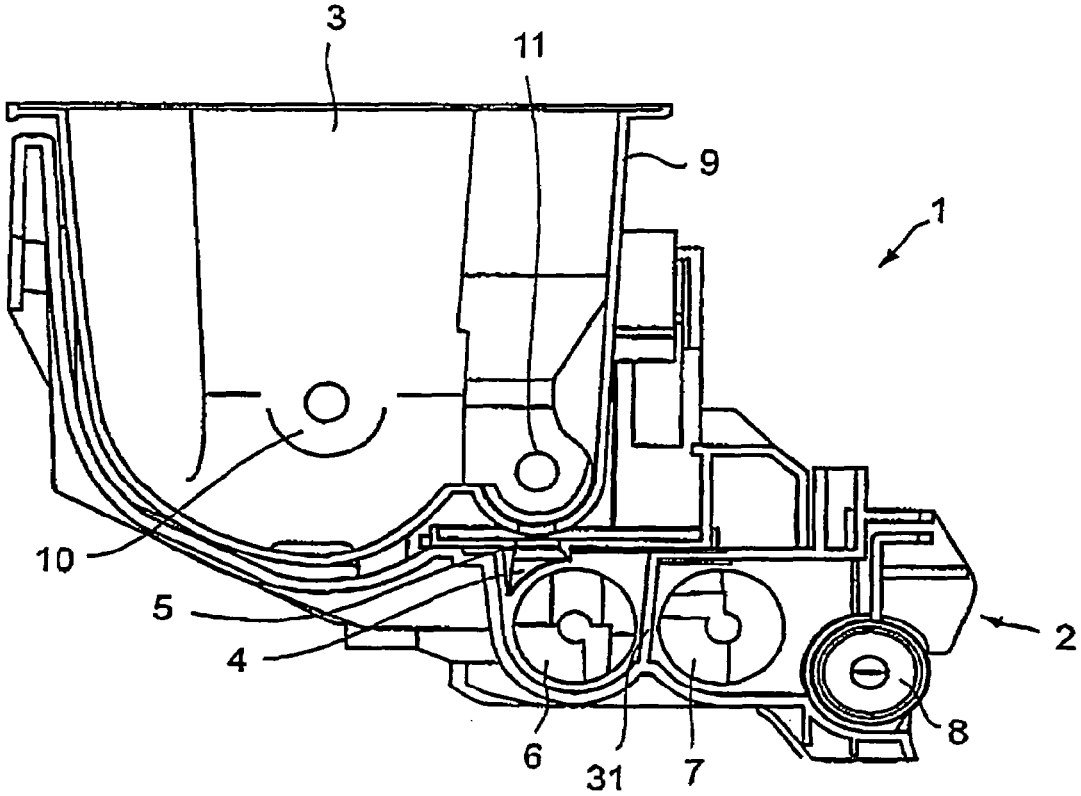
FIG. 1 is a schematic longitudinal sectional view of the first embodiment of the developing apparatus in an image forming apparatus according to the present invention.

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

In the drawings, reference numeral 1 is a developing apparatus, 2 is a developing device proper of the present invention, and 3 is a toner container as a toner accommodating means composed to be attachable to and detachable from the developing device proper 2 with toner accommodated therein. Reference numeral 5 is toner receiving opening formed in the developing device proper 2 above an agitation/transfer means 6, 4 is a guide member for guiding the toner falling from the toner container 3 to an agitation/ transfer means 6. The guide member 4 extends from the toner receiving opening 5 toward the agitation/transfer means 6 to surround the pathway of the falling from the toner container 3 to the agitation/transfer means 6. Reference numeral 7 is a developing roller side agitation/transfer means, and 8 is a developing roller which integrates piled magnets inside it. The developing roller 8 faces a photo conductor not shown in the drawings and carries toner on the surface thereof for developing the latent image formed on the surface of the photo conductor in the well known manner. Reference numeral 9 is a housing of the toner container 3, and 10 is a transfer means for transferring the toner accommodated in the toner container 3 toward a transfer means 11 provided in the toner container 3. The transfer means 10 and 11 become connected to a driving source for driving the developing roller 8 by means of gear, etc. provided in the developing device proper 2 when the toner container 3 is mounted to the developing device proper 2.

Figure 2:
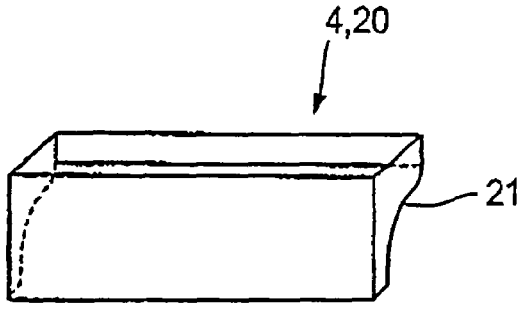
FIG. 2 is an embodiment of the toner guide member provided at the toner receiving opening of the developing apparatus or at the toner supply opening of the toner supply means (toner container) of the developing apparatus in an image forming apparatus according to the present invention.
Figure 5:
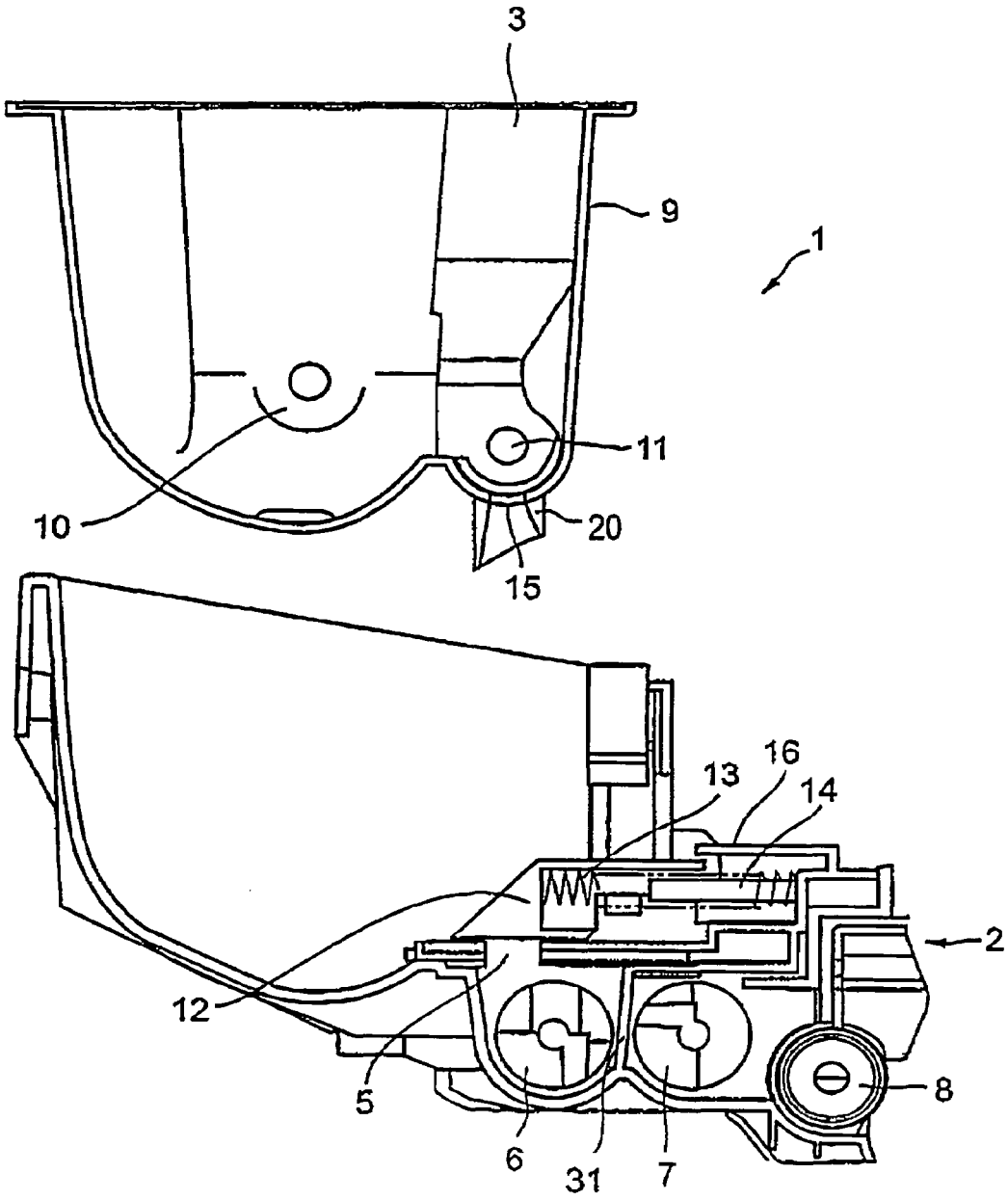
FIG. 5 is a schematic longitudinal sectional view of the second embodiment of the developing apparatus in an image forming apparatus according to the present invention, in which the toner accommodating means are shown separated from the developing device proper.
Figure 6:
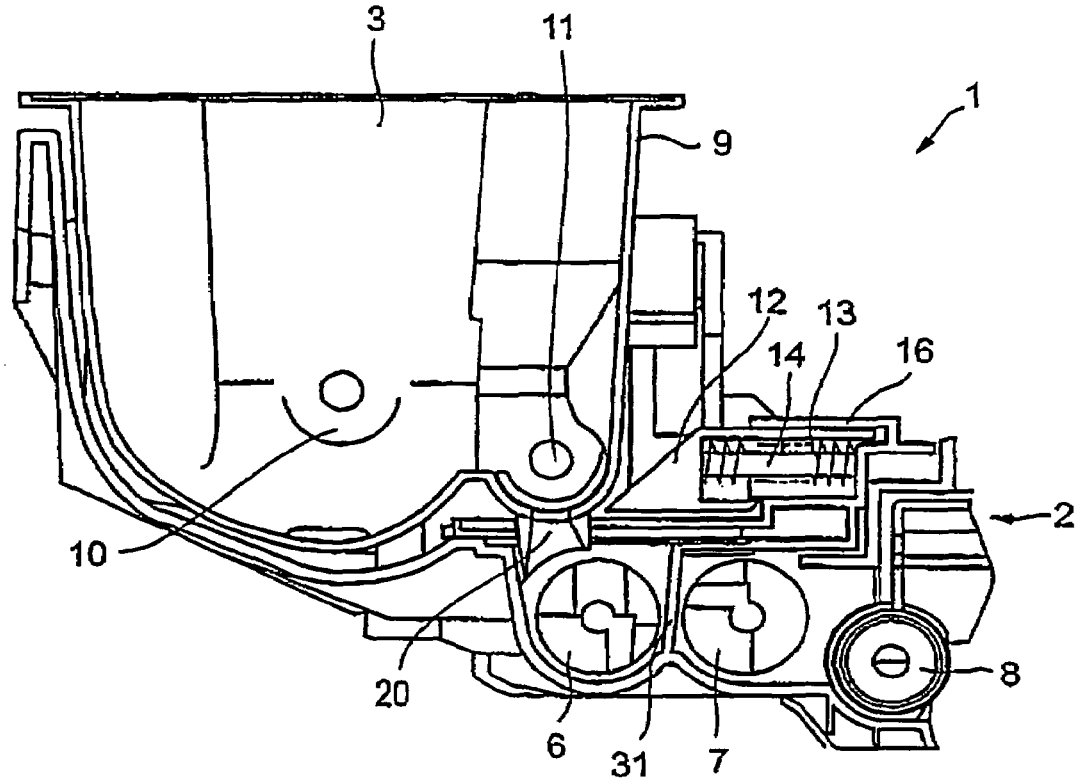
FIG. 6 is a schematic longitudinal sectional view showing the state the toner accommodating means is mounted on the developing device proper, each being shown in FIG. 5.

Reference numeral 12 in FIG. 5, FIG. 6 is a shutter for opening or closing the toner receiving opening 5 in the developing device proper 2, 13 is a spring for shifting the shutter 12 to the position the toner receiving opening 5 is closed. 14 is a supporting bar for supporting the spring 14 and at the same time for determining the opened position of the shutter 12, and 16 is a shifting guide member of the shutter. Reference numeral 20 is a guide member which is attached to the toner container 3 at the toner supply opening 15 and extends toward the agitation/transfer means 6 near to the same to surround the pathway of the toner falling from the toner container 3 in order to guide the toner to the agitation/transfer means 6 when the toner container 3 is mounted to the developing device proper 2. The guide member 20 is similar in shape as that of the guide member 4, and in FIG. 2 the guide member is denoted by reference numeral 4 and at the same time by 20 for convenience sake. In FIG. 2, reference numeral 21 indicates the bottom edge part of the guide member 4 or 20.

Figure 3:
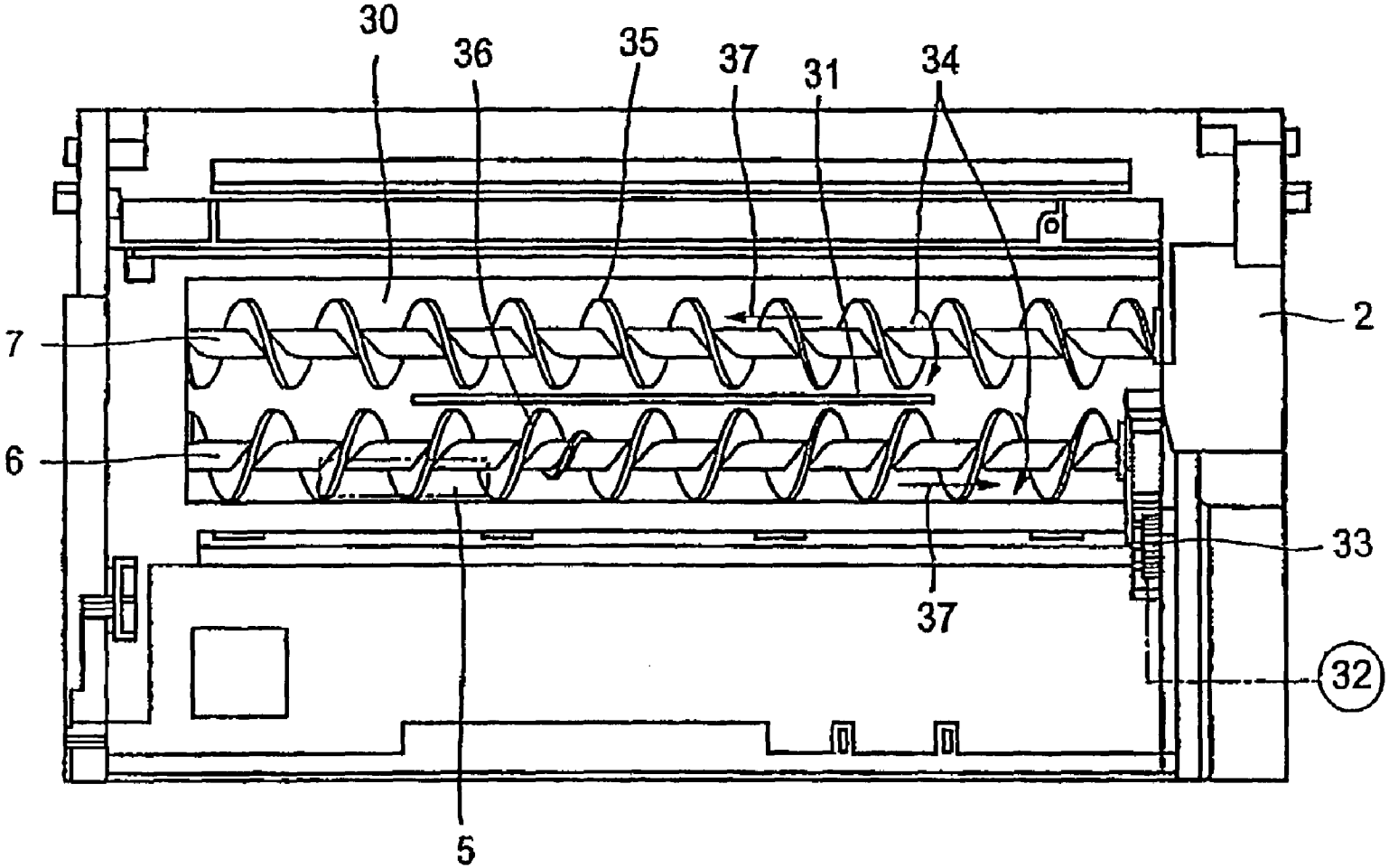
FIG. 3 is a plan view of the first embodiment of the developing apparatus in an image forming apparatus according to the present invention.
Figure 4:
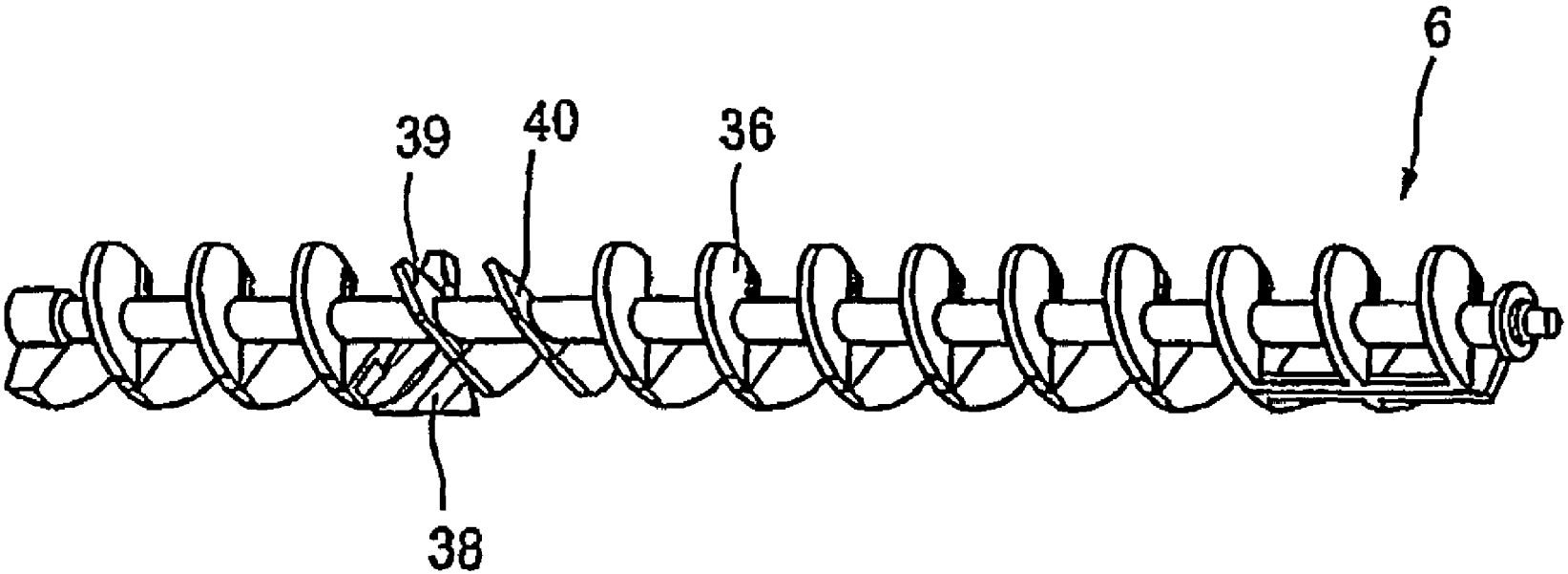
FIG. 4 is a perspective view of an embodiment of the agitation/transfer means composing the developing apparatus in an image forming apparatus according to the present invention.

Referring to FIG. 3, reference numeral 30 is a developing chamber of the developing device proper 2, 31 is an upright wall for separating the transfer passages of the agitation/transfer means 6, 7 in the developing chamber 31. The upright wall 31 is formed to be shorter in length than that of the developing chamber in longitudinal direction to provide a clearance between each side end of the developing chamber 30 and each side end of the upright wall 30. Therefore, the toner transferred by the agitation/transfer means 6, 7 passes through the clearances between both side ends of the developing chamber 30 and upright wall 31 to be circulated. Reference numeral 32 is a driving source for driving the developing roller 8 and the agitation/transfer means 6, 7, 33 is a gear for transmitting the driving force of the driving source 32 to the agitation/transfer means 6 and 7, 34 are arrows showing the rotation direction of the agitation/transfer means 6, 7, 35 and 36 each is a spiral vane member of the agitation/transfer means 7 and 6 respectively, and 37 are arrows showing the tranefer directions of toner. In FIG. 4, reference numeral 38 is a scraper, 39 and 40 indicate the portions of the vane member of the agitation/transfer means 6 reduced in transferring ability in a zone downstream from the toner receiving opening 5. The reduction in transferring ability is achieved by reducing the pitch and diameter of the spiral vane member 36 of said portion, or reducing only the pitch or only the diameter thereof, or cutting-out a part thereat or omitting the spiral vane of said portion. Although a so-called one-component developer composed of only toner or a so-called two-component developer composed of toner and carrier particles may be used in the developing apparatus in an image forming apparatus of the present invention, the developer will be called simply as toner in the following explanation.

First Embodiment

The first embodiment of the developing apparatus in an image forming apparatus according to the present invention is provided, as shown in FIG. 1, with the detachable/attachable toner container 3 as a toner accommodating means mounted above the developing device proper 2 with toner contained therein, the developing device proper 2 being provided with the toner guide member 4 which extends from the toner receiving opening toward the agitation/transfer means 6 near to the same to surround the pathway of the toner falling from the toner container 3 to guide the toner to the agitation/transfer means 6 preventing the toner from staying or piling between the agitation/transfer means 6 and inner wall of the developing device proper 2.

The guide member 4 is formed to have the bottom edge part 21 curved to run along the rotational circumference of the vane member 36 (see FIGS. 3 and 4) of the agitation/transfer means 6 with a clearance of, for example, 1–2 mm or so on and at the same time to have a guide face inclined by an angle of, for example, 50 to 70 degrees, preferably 60 degrees to be broaden toward end, as shown in FIGS. 1 and 2.

The upright wall 31 is provided in the developing chamber 30 as shown in FIG. 3 showing a plan view of the developing device proper 2 with the structure located above the agitation/transfer means 6 and 7 being removed. The agitation/transfer means 6, 7, each having the spiral vane 35, 36, are provided at both sides of the upright wall 31, the spiral vanes being spiraled contrary to each other. The agitation/transfer means 6, 7 are driven in the same direction as shown with arrows 34 by the gear 33, etc. for transmitting the driving force of the driving source 32 of the developing roll 8. Therefore, the toner supplied through the toner guide member 4 extending from the toner receiving opening 5 indicated by a chain line is transferred while being agitated by the vane members 35, 36 in both sides of the upright wall 31 in the direction indicated with each of arrows 37.

The driving force of the driving source 32 for driving the developing roller 8 is transmitted through the gear not shown in the drawings to the transfer means 10, 11 in the toner container 3 as a toner accommodating means shown in FIG. 1, and the toner in the toner container 8 is circulated therein while being transferred by the transfer means 10 to the transfer means 11 side and vice versa. On the other hand, in the developing device proper 2, the driving force of the driving source 32 is transmitted via the gear 33 to the agitation/transfer means 6, 7, and the toner is transferred while being agitated in the developing chamber 30 to the developing roller 8 (not shown in FIG. 3). The toner is carried on the developing roller 8 to be consumed to develop the latent image on the photo conductor not shown in the drawings. When the amount of toner in the developing chamber decreases by said consumption and the amount of toner between the agitation/transfer means 6 and the supply opening of the toner container 3 decreases, the toner in the toner container 3 falls onto the agitation/transfer means 6 from the toner receiving opening 5 provided in the developing device proper 2 through the guide member 4.

The scraper 38 is attached, as shown in FIG. 4, to the agitation/transfer means 6 having the spiral vane 36 at the portion of the spiral vane under the toner receiving opening 5 of the developing device proper 2, to be more specific, at the portion of the spiral vane 36 downstream from the upstream side end of the toner receiving opening 5 by a distance of about a quarter of the length of the opening 5, and at the same time the shape of the vane member of the portion downstream from the toner receiving opening 5, which is shown with reference numerals 39, 40, is formed different from that of the other portion so that the transferring ability of said portion is partially decreased. The toner receiving opening 5 is formed at a portion about one third of the length of the agitation/transfer means 6 from the upstream side end thereof, and its length is about a quarter of the length of the agitation/transfer means 6, so that there also a merit that the deflection of the agitation/transfer means 6 is not so influential and as a result the leakage of toner between the agitation/transfer means 6 and inner wall of the developing device proper 2 does not occur.

When the toner is transferred by the agitation/transfer means 6 while being agitated in the developing chamber 30 in the direction of arrow 37 a part of the toner increased in amount by the toner supplied from the toner container 3 as a toner accommodating means can stay in the portions of the spiral vane member indicated with reference numeral 39, 40 without all of the toner supplied at one time transferred downward, since the portions 39, 40 of the vane member are reduced in transferring ability as mentioned above. Therefore, there will not be developed a space soon between the agitation/transfer means 6 and the toner receiving opening 5, the free falling of toner from the toner container 3 stops and the phenomenon does not occur that toner is excessively supplied to the developing chamber 30.

The toner to be supplied from the toner container 3 is guided by the guide member 4 from the toner receiving opening of the developing apparatus 2 to the agitation/transfer means 6, and the guide member 4 is formed in the shape broaden toward the agitation/transfer means side, that is, toward the bottom edge part 21 of the guide member 4, so that the cross sectional area of the guide passage increases toward the agitation/transfer means 6. Therefore, even if the toner falling through the guide passage cakes near the toner receiving opening 5, the thickness of the caked toner layer is thinner compared to the case of an apparatus of prior art, and the caked toner layer is collapsed by its own weight and by the discharge pressure of toner from the toner container 3. Further, if greater-than-usual amount of toner cakes in the passage under the circumstance of high-temperature and high-humidity or when great amount of toner is supplied when toner consumption is large and the toner cake can not be collapsed by its own weight and discharge pressure of toner from the toner container, the toner cake can be positively collapsed by the scraper 38 attached to the vane member 36 at the part facing the vicinity of the toner receiving opening 5.

Further, as the agitation/transfer side of the guide member 4, that is, the bottom edge part 21 of the guide member 4 is shaped to run along the rotational circumference of the vane member 36 of the agitation/transfer means 6, the leakage of toner from the space between the guide member 4 and the agitation/transfer means 6 to the space between the inner wall of the developing device proper 2 and agitation/transfer means 6 can be suppressed to a minimum, and as a result the remaining or clogging of toner there can be prevented. Therefore, the occurrence of irregular image formation due to shortage of toner caused by the phenomenon that toner cakes between the inner wall of the developing device proper 2 and agitation/transfer means 6 and can not fall freely from the toner container 3 and the supply of toner to the agitation/transfer means 6 is obstructed can be prevented.

Second Embodiment

The second embodiment of the developing apparatus 1 in an image forming apparatus according to the present invention is illustrated in FIG. 5, in which the developing device proper 2 and the toner container as a toner accumulating means 3 are shown separately. FIG. 6 shows the state the toner container 3 is mounted to the developing device proper 2. Referring to FIG. 5 and FIG. 6, a guide member 20 which corresponds to the guide member 4 in the first embodiment of FIG. 1 is attached to the toner container 3 at the toner supply opening 15 not to the developing device proper 2 at the toner receiving opening 5 to surround the pathway of the toner falling from the toner container 3. When the toner container 3 is demounted from the developing device proper 2, the toner receiving opening 5 can be closed by a shutter 12 provided in the developing device proper 2 side. The developing device proper 2 which is the part of the developing apparatus with the structure above the agitation/transfer means 6, 7 removed as shown in FIG. 3, and the agitation/transfer means 6 shown in FIG. 4 are the same as those of the first embodiment their action being the same too.

The guide member 20 of the second embodiment is formed such that the bottom edge part 21 runs along the rotational circumference of the vane member 36 of the agitation/transfer means 6 with a clearance of, for example, 1~2 mm or so on when the toner container 3 is mounted to the developing device proper 2, and a guide face of the guide member 20 is inclined by an angle of, for example, 50 to 70 degrees, preferably 60 degrees to be broaden toward end, similarly as the case of the first embodiment shown in FIG. 1.

As described before, the driving force of the driving source 32 for driving the developing roller 8 is transmitted through the gear not shown in the drawings to the transfer means 10, 11 in the toner container 3 as a toner accommodating means shown in FIG. 1, and the toner in the toner container 3 is sent to the transfer means 11 side by the transfer means 10 while being circulated therein. In the developing device proper 2, the driving force of the driving source 32 is transmitted via the gear 33 to the agitation/transfer means 6 and 7, the toner is sent while being agitated in the developing chamber 30 to the developing roller 8. This toner is carried on the developing roller 8 to be consumed to develop the latent image on the photo conductor not shown in the drawings. When the amount of toner in the developing chamber decreases due to said consumption, the toner in the toner container 3 falls from the toner supply opening 15 onto the agitation/transfer means 6 through the guide member 20.

As the guide member 20 is formed in the shape broaden toward the agitation/transfer means side, the cross sectional area of the guide passage increases toward the agitation/transfer means 6. Therefore even if the toner falling through the guide passage cakes in the part thereof near the agitation/transfer means 6, the thickness of the caked toner layer is thinner compared to the case of the apparatus of prior art, and the caked toner layer is collapsed by its own weight and by the discharge pressure of toner from the toner container 3. Further, even if the toner cake can not be collapsed by its own weight and discharge pressure of toner from the toner container, the toner cake can be surely collapsed by the scraper 38 attached to the part of vane member 36 of the agitation/transfer means 6 which is facing the vicinity of the toner receiving opening 5.

Further, as the agitation/transfer side of the guide member 20, that is, the bottom edge part 21 of the guide member 20 is shaped to run along the rotational circumference of the vane member 36 of the agitation/transfer means 6 the amount of toner leaked from the space between the guide member 20 and agitation/transfer means 6 to the space between the inner wall of the developing device proper 2 and agitation/transfer means 6 can be suppressed to a minimum, and as a result the remaining or clogging of toner there can be prevented. Therefore, malfunctions such as the occurrence of irregular image formation, etc. due to the shortage of toner caused by the phenomenon that, toner cakes between the inner wall of the developing apparatus 2 and agitation/transfer means 6, can not fall freely, and can not be supplied to the agitation/transfer means 6 as is the case with the prior developing apparatus, can be prevented.

With the second embodiment, when the toner in the toner container 3 is consumed and the toner container 3 is removed from the developing device proper 2 as shown in FIG. 5, the shutter 12 which is pushed by the spring 13 closes the toner receiving opening 5 of the developing device proper 2. Although there may happen that when the toner container 3 is removed, the toner remaining in the toner container 3 piles on the agitation/transfer means 6 of the developing device proper 2, the piled toner can be collapsed by the guide member 20 when the toner container 3 newly filled with toner is mounted.

When the toner container 3 is mounted to the developing device proper 2, first the guide member 20 attached to the toner container 3 at the toner supply opening 15 touches the inclined plane of the shutter 12 and pushes the shutter 12 in the right direction in FIG. 5. Then the shutter 12 shifts toward right against the force of the spring 13 along a shift guide member 16, and the toner receiving opening 5 of the developing device proper 2 becomes opened. When the guide member 20 advances through the toner receiving opening 5 into the developing device proper 2, the toner piled between the agitation/transfer means 6 and toner receiving opening 5 is collapsed by the guide member 20, and the problem of piling up of toner is eliminated. As shown in FIG. 6, when the toner container 3 is perfectly mounted to the developing device proper 2, the shutter 12 is stopped at the position it contacts the support bar 14, and the guide member 20 becomes positioned so that the part indicated with reference numeral 21 in FIG. 2 of the guide member 20 attached to the toner container 3 keeps a predetermined clearance between the rotational circumference of the vane member 36 of the agitation/transfer means 6.

Therefore, the toner piled on the agitation/transfer means 6 of the developing device proper 2 can be collapsed by the guide member 20, and at the same time the phenomenon can be prevented that toner intrudes and resides in the space between the outer fringe part of the vane member 36 of the agitation/transfer means 6 and the inner wall of the developing device proper 2. Accordingly, as the phenomenon that the toner residing in the space clogs there and does not freely fall from the toner container 3 is prevented or alleviated, the occurrence of irregular image formation due to the shortage of toner supply to the agitation/transfer means 6 can be prevented.

Further, as the toner receiving opening 5 of the developing device proper 2 is closed or opened by the shutter 12 when the toner container 3 is demounted or mounted, demounting and mounting of the toner container 3 can be done without caring about the opening or closing of the toner receiving opening 5 and the occurrence of the scattering of toner is eliminated.

When the toner is transferred by the agitation/transfer means 6 while being agitated in the developing chamber 30 in the direction of the arrow 37, a part of the toner increased in amount by the toner supplied from the toner container 3 can remain in the portions of the spiral vane member indicated with reference numeral 39, 40 without all of the toner supplied at one time transferred downward, since the portions 39, 40 of the vane member are reduced in transferring ability as mentioned above. Therefore, there will not be developed a space soon between the agitation/transfer means 6 and the toner receiving opening 5, so that the falling of toner from the toner container 3 stops and the phenomenon does not occur that toner is excessively supplied to the developing chamber 30.

To investigate the clogging of toner in the first and second embodiment of the developing apparatus described in the forgoing, an image forming apparatus was prepared, which had an OPC(organic photo conductor) drum of positively charged single layer type of diameter of 30 mm, used toner which contains as internal additives 40% of magnetic powder and 2% of wax, as external additives 1.1% of silica, and as an abrasive 1.4% of titanium oxide, and was classified so that grain size was 6.3 $\mu$m at 25% (this means that, in the accumulation amount curve showing the relation between the grain size of toner and the percentage amount of toner of which grain size belongs to the range equal or smaller than said grain size, the average grain size of the amount of toner of from 0% to 25% is 6.3 $\mu$m, the same is meant hereunder), 7.5 $\mu$m at 50%, and 8.5 $\mu$m at 75% and in which magnetic jumping development was performed. Line speed ratios were determine so that that of the photo conductor to developing roller was 1.4, that of the developing roller to agitation/transfer means 7 was 0.48, and that of the agitation/transfer means 6 to 7 was 1.0, and the guide member 20 of inner size of 9×43 mm of which the oblique angle of the part widening toward end was 60 degrees, was attached so that the clearance between the bottom edge part thereof and rotational circumference of the vane member of the agitation/transfer means 6 was 1 mm.

The result of test operation with said image forming apparatus showed that the clogging of toner was very thin; the piled toner collapsed by its own weight and the pressure of the toner in the toner container 3 and at the same time the clogged toner is collapsed with the scraper 38; and the supply of toner to the developing roller 8 was not obstructed.

As mentioned above, according to the present invention, the intrusion of toner into the space between the periphery of the agitation/transfer means 6 and the inner wall of the developing device proper 2 is prevented by providing the simple and inexpensive guide member 4 at the toner receiving opening 5 of the developing device proper 2 or at the toner supply opening 15 of the toner accommodating means (container) 3 which constitutes a part of the developing apparatus 1 in order to surround the pathway of the toner falling from the toner container 3.

Particularly, according to the second embodiment of the present invention, the toner piled on the agitation/transfer means 6 of the developing device proper 2 can be collapsed by the guide member 20 when the toner container 3 is mounted to the developing device proper 2, and accordingly the phenomenon that toner can not fall freely from the toner container 3 obstructed by the toner residing and clogging near the toner receiving opening the toner 5 is prevented or alleviated, so that the occurrence of irregular image formation due to the shortage of toner supply to the agitation/transfer means 6 can be prevented.

Also, according to the present invention, since the guide member 4 or 20 is formed in the shape broaden toward the agitation/transfer means 6 side, even if toner cakes near the toner receiving opening 5 or the toner supply opening 15, the caked toner layer is thin, for the passage in the guide member 4 or 20 is widen toward the agitation/transfer means 6, and the caked toner layer is collapsed by its own weight or by the discharge pressure of toner from the toner container 3. Therefore, the occurrence of irregular image formation, etc. due to the hindrance of toner supply to the agitation/transfer means 6 is prevented.

Further, as the clearance between the bottom edge part 21 of the guide member 4 or 20 and the periphery of the vane member 36 of the agitation/transfer means 6 is practically even, the leakage of supplied toner from the space between the guide member 4 or 20 and agitation/transfer means 6 to the space between the inner wall of the developing device proper 2 and agitation/transfer means 6 can be suppressed to a minimum, the remaining or clogging of toner there can be prevented, and the occurrence of irregular image formation due to obstructed toner supply to the agitation/transfer means 6 can be prevented.

Also, according to the present invention, by providing the scraper 38 to the vane member 36 of the agitation/transfer means 6, even if toner piles in the guide member 4 or 20 the toner can be scraped out, and combined with the fact that the piling up of toner between the agitation/transfer means 6 and the inner wall of the developing device proper 2 is prevented, the occurrence of irregular image formation due to obstructed toner supply to the agitation/transfer means 6 can be prevented.

Also, according to the present invention, as the toner receiving opening 5 of the developing device proper 2 is closed when the toner accommodating means 3 is demounted and opened when the same is mounted, the mounting and demounting of the toner accumulating means 3 can be done without caring about the opening or closing of the toner receiving opening 5 and the occurrence of scattering of toner is eliminated.

What is claimed is:

1. A development apparatus in an image forming apparatus, the development apparatus comprising an agitation/transfer means for supplying a developer while agitating the same to a developing roller for developing a latent image formed on a photo conductor, a toner accommodating means having a toner supply opening being provided detachable from a developing apparatus body proper above said agitation/transfer means provided in the developing apparatus body proper, a toner receiving opening being formed in the developing apparatus body proper above the agitation/transfer means for receiving the toner from said toner accommodating means, wherein a guide member is provided surrounding said toner receiving opening of the developing apparatus body proper for guiding toner from the toner accommodating means to the agitation/transfer means and preventing a piling up of toner between the agitation/transfer means and inner wall of development apparatus body proper, and wherein a cross sectional area of toner guide passage of said toner guide member is increased from said toner receiving opening in a direction towards the agitation/transfer means.

2. The development apparatus in an image forming apparatus according to claim 1, wherein said toner guide passage of the guide member is formed in a shape broadening toward the agitation/transfer means.

3. The development apparatus in an image forming apparatus according to claim 1, wherein said agitation/transfer means is a rotation member having one or plurality of spiral blades (member-with-spiral-blade), and said guide member is located so that a vertical center line of the toner guide passage is offset from a vertical line passing through the center of rotation of the member-with-spiral-blade toward upstream of the rotation direction thereof.

4. The development apparatus in an image forming apparatus according to claim 3, wherein said guide member is located so that the vertical center line of the toner guide passage is offset from a vertical line passing through the center of rotation of the member-with-spiral-blade toward upstream of the rotation direction thereof, and a member-with-spiral-blade side opening end of the toner guide passage of said guide member is formed to run along the periphery of the spiral blade or blades of the agitation/transfer means.

5. The development apparatus in an image forming apparatus according to claim 1, wherein said agitation/transfer means is a rotation member having one or plurality of spiral blades (member-with-spiral-blade), and a scraper is provided to the agitation/transfer means at a position facing a member-with-spiral-blade side opening end of the toner guide passage to scrape off the toner piled at the guide passage of the guide member.

6. The development apparatus in an image forming apparatus according to claim 1, wherein said guide member is located so that a vertical center line of the toner guide passage is offset from a vertical line passing through a center of rotation of a rotation member having one or plurality of spiral blades (member-with-spiral-blade) toward upstream of the rotation direction thereof, and a member-with-spiral-blade side opening end of the toner guide passage of said guide member is formed to run along the periphery of the spiral blade or blades of the agitation/transfer means.

7. A development apparatus in an image forming apparatus, the development apparatus comprising an agitation/transfer means for supplying a developer while agitating the same to a developing roller for developing a latent image formed on a photo conductor, a toner accommodating means having a toner supply opening being provided detachable from a developing apparatus body proper above said agitation/transfer means provided in the developing apparatus body proper, a toner receiving opening being formed in the developing apparatus body proper above the agitation/transfer means for receiving the toner from said toner accommodating means, wherein a guide member is provided surrounding the toner supply opening of the toner accommodating means for guiding toner from the toner accommodating means to the agitation/transfer means and preventing a piling up of toner between the agitation/transfer means and inner wall of development apparatus body proper, and wherein a cross sectional area of toner guide passage of said toner guide member is increased from said toner receiving opening in a direction towards the agitation/transfer means.

8. The development apparatus in an image forming apparatus according to claim 7, wherein said toner guide passage of the guide member is formed in a shape broaden toward the agitation/transfer means, and the guide member protrudes through the toner receiving opening in the developing apparatus body proper down below the toner receiving opening when the toner accommodating means is mounted to the developing apparatus body proper.

9. The development apparatus in an image forming apparatus according to claim 7, wherein said agitation/transfer means is a rotation member having one or plurality of spiral blades(member-with-spiral-blade), and said guide member is located so that a vertical center line of the toner guide passage is offset from a vertical line passing through the center of rotation of the member-with-spiral-blade toward upstream of the rotation direction thereof.

10. The development apparatus in an image forming apparatus according to claim 7, wherein said guide member is located so that a vertical center line of the toner guide passage is offset from a vertical line passing through a center of rotation of a rotation member having one or plurality of spiral blades (member-with-spiral-blade) toward upstream of the rotation direction thereof, and a member-with-spiral-blade side opening end of the toner guide passage of said guide member is formed to run along the periphery of the spiral blade or blades of the agitation/transfer means.

11. The development apparatus in an image forming apparatus according to claim 7, wherein said agitation/transfer means is a rotation member having one or plurality of spiral blades(member-with-spiral-blade), and a scraper is provided to the member-with-spiral-blade at a position facing a member-with-spiral-blade side opening end of the toner guide passage to scrape off the toner piled at the guide passage of the guide member.

12. The development apparatus in an image forming apparatus according to claim 7, wherein said development apparatus body proper is provided with a shutter mechanism, the shutter being opened or closed by utilizing the protruded part of the guide member attached to the toner accommodating means to protrude from the toner receiving opening down below the toner receiving opening in the development apparatus body proper when the toner accommodating means is mounted to the developing apparatus body proper.

* * * * *